US008205624B2

(12) United States Patent
Gueret

(10) Patent No.: US 8,205,624 B2
(45) Date of Patent: Jun. 26, 2012

(54) APPLICATOR FOR APPLYING A COMPOSITION TO THE EYELASHES OR THE EYEBROWS

(75) Inventor: Jean-Louis H. Gueret, Paris (FR)

(73) Assignee: L'Oréal S.A., Paris (FR)

( * ) Notice: Subject to any disclaimer, the term of this patent is extended or adjusted under 35 U.S.C. 154(b) by 976 days.

(21) Appl. No.: 12/000,419

(22) Filed: Dec. 12, 2007

(65) Prior Publication Data

US 2008/0271746 A1 Nov. 6, 2008

Related U.S. Application Data

(60) Provisional application No. 60/883,268, filed on Jan. 3, 2007.

(30) Foreign Application Priority Data

Dec. 12, 2006 (FR) ..... 06 55450

(51) Int. Cl.
*A45D 40/26* (2006.01)

(52) U.S. Cl. ..... 132/218; 132/320

(58) Field of Classification Search ..... 132/218, 132/120, 126, 320; 401/128–130; 119/630, 119/631, 632, 626, 612, 664
See application file for complete search history.

(56) References Cited

U.S. PATENT DOCUMENTS 2,007,245 A * 7/1935 Gimonet ..... 132/218
4,500,939 A * 2/1985 Gueret ..... 361/221
5,709,230 A * 1/1998 Miraglia ..... 132/218
6,412,496 B1 7/2002 Gueret
6,446,637 B2 9/2002 Gueret
6,539,950 B1 4/2003 Gueret
6,546,937 B2 4/2003 Gueret
6,581,610 B1 6/2003 Gueret
6,655,390 B2 12/2003 Gueret
7,077,592 B2 7/2006 Gueret
7,125,188 B2 10/2006 Gueret
2001/0003785 A1 6/2001 Protzmann et al.
2001/0037815 A1 11/2001 Gueret
2001/0047808 A1 12/2001 Gueret
2002/0005209 A1 1/2002 Gueret
2002/0020424 A1 2/2002 Gueret
2003/0235454 A1 12/2003 Gueret
2004/0168698 A1 9/2004 Gueret
2004/0240926 A1 12/2004 Gueret
2005/0232681 A1 10/2005 Gueret

FOREIGN PATENT DOCUMENTS

CN 1330904 A 1/2002

(Continued)

OTHER PUBLICATIONS

Office Action dated Jul. 10, 2009 re Chinese Application No. 2007101987400.

(Continued)

*Primary Examiner* — Rachel Steitz

(57) ABSTRACT

An applicator for applying a composition to eyelashes or eyebrows, includes a support structure that is elongate along a longitudinal axis. The support structure may include i) at least one branch member that is within the support structure at least in part, the support structure being an open-work structure; and/or ii) at least one branch member having a free end. The branch member may extend, at least in part, obliquely relative to the longitudinal axis of the support structure and may include teeth.

60 Claims, 11 Drawing Sheets

FOREIGN PATENT DOCUMENTS

| | | | |
|---|---|---|---|
| EP | 1 169 941 | B1 | 1/2002 |
| EP | 1 584 260 | A2 | 10/2005 |
| FR | 2 810 860 | A1 | 1/2002 |
| FR | 2 836 031 | A1 | 8/2003 |
| FR | 2 850 549 | A1 | 8/2004 |
| FR | 2 852 500 | A1 | 9/2004 |
| WO | WO 01/05273 | A1 | 1/2001 |

OTHER PUBLICATIONS

French Search Report for FR 0655450, dated Aug. 15, 2007.

* cited by examiner

APPLICATOR FOR APPLYING A COMPOSITION TO THE EYELASHES OR THE EYEBROWS

This application claims benefit of U.S. Provisional Application No. 60/883,268, filed Jan. 3, 2007, the contents of which are incorporated herein by reference. This application also claims benefit of priority under 35 U.S.C. §119 to French Patent Application No. 06 55450, filed Dec. 12, 2006, the contents of which are also incorporated by reference.

The present invention relates to applicators for applying a composition to eyelashes or eyebrows, in particular a cosmetic, makeup, or a care product, e.g. mascara.

BACKGROUND

International application WO 01/05273 discloses a comb for applying mascara, the comb comprising a support having a longitudinal axis and carrying teeth disposed in at least two rows each comprising at least two teeth that are spaced apart by a distance that is less than the distance between the two rows.

European Patent Application EP-A1-1 169 941 teaches an applicator comprising: a support defining an opening that is situated between two opposite regions of the support; and projecting elements that are connected to one of the regions and that are directed towards the other region. In an embodiment shown in that application, the applicator includes teeth that are situated on branch members of the support and that extend perpendicularly to the longitudinal axis of the support.

There exists a need for an applicator that is capable of being loaded sufficiently with composition while being capable of applying the composition conveniently to eyelashes or eyebrows, and of combing and of separating eyelashes or eyebrows in satisfactory manner. There also exists a need for an applicator that is capable of coming into contact with a relatively large fraction of a set of eyelashes or of an eyebrow.

SUMMARY

In the following description, certain aspects and embodiments of the present invention will become evident. It should be understood that the invention, in its broadest sense, could be practiced without having one or more features of these aspects and embodiments. In other words, these aspects and embodiments are merely exemplary.

At least some examples of the invention may satisfy one or more of the above-mentioned needs. For example, at least some non-limiting embodiments relate to an applicator having a relatively large surface area for combing and impregnating eyelashes or eyebrows with a composition.

In one aspect, an applicator may be provided for applying a composition to eyelashes or eyebrows, the applicator comprising a support structure (e.g., for supporting teeth) that is elongate along a longitudinal axis. The support structure may comprise i) at least one branch member that is within the support structure at least in part, the support structure being an open-work structure, and/or ii) at least one branch member having a free end. The branch member may extend, at least in part, obliquely relative to the longitudinal axis of the support structure and may include teeth.

In some examples, the "open-work structure" may include one or more open-work cavities. One example of an open-work cavity is a void passing through the support structure.

In some embodiments, the support structure may include at least one branch member that is within the support structure at least in part, wherein the support structure is an open-work structure. In at least some of such embodiments, wherein the support structure is an open-work structure, composition can pass through one or more open-work cavities of the support structure. This may facilitate loading the applicator with composition and/or may improve application. The support structure comprising one or more branch members may also make it possible to improve homogenization of the composition and mixing of the composition in a receptacle in which it is contained.

The support structure may comprise an elongate main support along the longitudinal axis, and a plurality of branch members that are connected to the main support and that define, at least in part, open-work cavities of the support structure. (As used herein, the term "connected" is not limited to having separate pieces joined together and includes unitary, one piece arrangements; for example, branch members "connected" to a support include either a unitary, one piece arrangement of the branch members and main support, or an arrangement including the branch members and the main support being fastened to one another.) The main support may define the outline of the support structure when the support structure is observed from above, the main support being in the form of a frame, for example.

The applicator may comprise one row of at least three teeth extending from the corresponding branch member of the support structure on one face thereof, or at least two rows of teeth extending from the same branch member but on opposite faces, or from different branch members, or at least three rows, each having at least three teeth, with each tooth extending from a branch member of the support structure on one face thereof.

The row(s) of teeth may extend, at least in part, obliquely relative to the longitudinal axis of the support structure.

At least one open-work cavity of the support structure, may extend, at least in part, between two branch members each carrying a row of teeth.

The teeth of at least one row may be disposed on the corresponding branch member along an axis of the row extending, at least in part, obliquely relative to the longitudinal axis of the main support.

The term "row" should be understood as a succession of teeth that are relatively close to one another, and that are suitable for being associated with (e.g., carried by) a single support element, in particular, a single branch member of the support structure.

Each branch member may include (e.g., carry) at least one row of teeth, and, in use, teeth belonging to two rows may be brought into contact with eyelashes simultaneously.

The term "obliquely" should be understood as meaning that the axis of the branch member or of the row extends in a manner that is neither completely parallel, nor completely perpendicular, to the longitudinal axis of the main support. Such a definition does not exclude the axis of the row or of the branch member from extending, over a fraction of its length, parallel or perpendicularly to the longitudinal axis of the support structure, which, like the axis of the row, may be rectilinear or curved.

The orientation of the rows of teeth may be selected in such a manner as to enable the applicator to improve penetration and thus combing of eyelashes or eyebrows.

The support structure may present a generally and/or substantially flat shape. This may enable a greater number of teeth to come into contact with eyelashes or eyebrows.

The support structure may define at least two open-work cavities, or at least three open-work cavities.

The at least three open-work cavities may occupy successive axial positions relative to the longitudinal axis, i.e. the at least three open-work cavities may be situated in succession, parallel to the longitudinal axis.

The applicator may include open-work cavities and teeth in alternation along a direction that is parallel to the longitudinal axis of the support structure. The open-work cavities and teeth may alternate over more than half the length of the support structure.

The applicator may include open-work cavities and teeth in alternation along a transverse direction that is perpendicular to the longitudinal axis of the main support structure. The open-work cavities and teeth may alternate over more than half the width of the support structure.

By way of example, the number of open-work cavities included in the applicator may be in the range of 3 to 100, e.g. in the range of 10 to 80.

At least one open-work cavity of the support structure (e.g. at least the three above-mentioned open-work cavities or, alternatively, most or all of the open-work cavities) may have a size that enables composition to be retained therein. When retained in the open-work cavities, the composition may cover (e.g., hide) all or at least part of the open-work cavity concerned when the cavity is observed along its axis, after loading the applicator with composition.

At least one open-work cavity (or most of the open-work cavities) may present a greatest dimension that is less than or equal to 3 millimeters (mm). In some embodiments, the greatest dimension may be less than or equal to 2 mm, or less than or equal to 1.5 mm.

The open-work cavities may present substantially the same shape in some embodiments. The open-work cavities may be of any shape. At least one open-work cavity, or all or most of the open-work cavities, may be closed circumferentially when observed from above.

For example, an open-work cavity may be defined entirely by a plurality of branch members when the applicator is observed from above along the axis of the open-work cavity.

The applicator may also comprise a support structure comprising a central core. By way of example, the core may extend in line with a stem of the applicator having the support structure fastened to one end thereof. The core may by rectilinear or curved.

The applicator may comprise a support structure comprising a closed frame that may possibly define, in part, at least one open-work cavity. The branch members may optionally extend parallel to a plane, e.g., in a plane defined by the frame or outside such a plane.

The outline of the applicator member, defined by the outline of the above-mentioned frame, for example, may, in plan view, have a shape selected from the following list: triangular, lenticular, kidney-shaped, rectangular, or peanut shaped, this list not being limiting.

The applicator may comprise at least one branch member comprising two ends that are connected to the remainder of the support structure, e.g., to the above-mentioned frame. All or most of the branch members may comprise two ends that are connected to the remainder of the support structure.

In some embodiments, branch members including teeth may be connected together at a location other than at their ends. For example, branch members may be connected via other branch members, the other branch members optionally being connected at their ends to the above-mentioned frame.

The applicator may comprise at least one branch member that is connected to the remainder of the support structure via a single junction zone, in particular when the support structure comprises a central core.

All or most of the branch members may be connected to the remainder of the support structure via a single junction zone.

The junction zone may be situated between the two ends of the branch member, e.g. being situated at its middle, on or in the longitudinal vicinity of the support structure. In a variant, the junction zone may be situated at an end of the branch member.

By way of example, the total number of teeth comprised in the applicator may be in the range of 20 to 800, e.g. in the range of 20 to 300 per face, e.g. in the range of 40 to 200 per face. In some embodiments, the total number of teeth included in the applicator may be in the range of 120 to 360, for example.

Where appropriate, the number of teeth per face of the applicator may be different, in order to produce different makeup results.

The applicator member may present three faces or more, each comprising teeth.

Each face of the support structure may optionally extend generally parallel to a plane.

In some embodiments, the number of teeth comprised on one face of the applicator may be in the range of 10 to 100 per square centimeter ($cm^2$) or in the range of 20 to 80 per $cm^2$, the teeth being evenly distributed in both directions, for example.

By way of example, the number of branch members comprised in the applicator may be in the range of about 5 to about 50, e.g. in the range of 7 to 40 or in the range 9 to 30, the branch members possibly being at least in part within the support structure, or even completely within the support structure.

The distance between the branch members may be constant or it may vary.

At least one branch member, or all or most of the branch members, may be rectilinear.

At least one branch member, or all or most of the branch members, may be non-rectilinear. For example, one or more branch members may be curved in a plane containing the longitudinal axis of the support structure, or, in a variant, may be curved in a plane that does not contain the longitudinal axis of the support structure.

At least one-branch member may be convex when observed along the longitudinal axis of the support structure, with a thickness passing through a maximum, for example.

The applicator may comprise two adjacent branch members that are spaced apart by a distance in the range of 0.01 mm to 2 mm, e.g., in the range of 0.1 mm to 1 mm or in the range 0.5 mm to 0.8 mm, the distance being measured between the adjacent edges of the branch members.

At least one branch member, or all or most of the branch members, may extend on either side of the longitudinal axis of the support structure when the applicator is observed from above.

When observed from above, the applicator member may present a face that includes a plurality of rows of teeth, each crossing the longitudinal axis of the applicator member and extending over a distance that is substantially equal on either side of a mid-plane.

The branch members may extend in a certain manner on one side of the support structure, e.g. in rectilinear manner, and in another manner on the opposite side of the support structure, e.g. in undulating manner.

In some embodiments, the branch members may extend in rectilinear manner over one face of the support structure, and also in rectilinear manner over the opposite face.

In other embodiments, the branch members may extend in undulating manner over one face of the support structure, and also in undulating manner over the opposite face of the support structure.

The applicator may comprise a support structure that is gridded, thereby making it easier to load with composition, to apply the composition, and to comb eyelashes or eyebrows.

In some embodiments in which the support structure is an open-work structure, particularly a gridded structure, the support structure may act as a mixer in a receptacle, so as to homogenize the composition before application, for example.

Teeth may extend outwards from a first face of the support structure from a first set of branch members, and teeth may extend outwards from a second face of the support structure, opposite from the first, from a second set of branch members.

The applicator may comprise branch members that intersect when observed from above. The branch members may optionally intersect in a regular manner.

The branch members of the first set and the branch members of the second set may be disposed at different heights relative to a geometrical mid-surface of the support structure.

The branch members of the first set may extend on a first side of the support structure, and the branch members of the second set may extend on another side of the support structure that is opposite from the first side, for example.

Some or all of the branch members of the first set may extend parallel to one another.

Some or all of the branch members of the second set may also extend parallel to one another.

The branch members of the first set may also extend at the same level, relative to a geometrical mid-surface of the support structure, as the branch members of the second set.

Some or all of the branch members of the first set may form a non-zero angle with some or all of the branch members of the second set. The angle may be in the range of 10° to 170°, for example in the range of 20° to 160°, e.g., in the range of 30° to 150°.

Free ends of the teeth may define an envelope surface. A cross-section of the envelope surface taken in a plane substantially orthogonal to the longitudinal axis, at least one point along the longitudinal axis, may be convex at least in part. In a variant or in addition, a cross section of the envelope surface may be, at least one point along the longitudinal axis, concave or planar at least in part.

The free ends of the teeth may define an envelope surface that is adapted to engage eyelashes, and that makes it easier to comb and separate eyelashes or eyebrows.

In particular, eyelashes may be engaged between a plurality of teeth of a plurality of rows while the composition is being applied.

As a function of the length of the teeth and of the disposition of the rows, the shape of the envelope surface may vary, thereby making it possible, where appropriate, to create portions in relief that enable eyelashes to be combed with a plurality of rows in a slanting movement.

The free ends of the teeth of two different branch members, in particular of two adjacent branch members, may define respective curved lines for each of the branch members. The two curved lines may each have a high point that is furthest away from a geometrical mid-surface of the support structure, where the geometrical mid-surface of the support structure is located mid-way through its thickness. The two high points may be situated differently from each other relative to the longitudinal axis of the support structure.

The free ends of the teeth of three different branch members, in particular of three consecutive branch members, may define respective curved lines for each of the branch members, the three curved lines each having a high point that is furthest away from a geometrical mid-surface of the support structure, the three high points not being in alignment.

At least one row, e.g., at least the three above-mentioned rows, most of the rows, or all of the rows of one face, may comprise at least four teeth, with the number of teeth being in the range of 4 to 25, for example. Teeth may have a height in the range of 1 mm to 12 mm, e.g., in the range of 2 mm to 8 mm or in the range of 3 mm to 6 mm. The distance between two teeth of one row may be shorter than the distance between the axes of two adjacent rows.

The height of the teeth may decrease at the ends of at least one row of teeth, or at the ends of each row. This may make application more progressive and/or may make the applicator easier to pass through a wiper member.

The height of the teeth may decrease at the proximal and distal ends of the support structure when the applicator is observed from the side.

The envelope surface of the applicator may present a convex longitudinal section when the applicator is observed from the side.

At least one open-work cavity, e.g. at least every other open-work cavity, need not have teeth extending over the open-work cavity.

At least one tooth may extend, from the corresponding branch member, in a direction that is perpendicular to the longitudinal axis of the support structure.

In some embodiments, wherein the support structure has a shape that is flat in a plane, a plurality of teeth may extend perpendicularly to the plane.

At least one tooth may extend, from the corresponding branch member, in a direction that is not perpendicular to the longitudinal axis of the support structure. At least one tooth may form an angle with the corresponding branch member that is less than 90°.

The applicator may comprise teeth that are disposed in parallel rows, and the axis along which at least one row of teeth extends may optionally be rectilinear, in particular curvilinear, e.g. outwardly concave or convex.

The axis of at least one row of teeth may be sinuous. The axis of a row of teeth is thus defined by the line that passes through the centers of the bases of the teeth.

The applicator may comprise at least two teeth of different shapes that extend from a single branch member or from two different branch members, for example.

The applicator may include teeth that extend from a main support of the support structure, from which the branch member(s) extend.

At least a plurality of consecutive teeth of a row may be disposed in a staggered configuration, or in some other configuration, on the corresponding branch member.

A plurality of consecutive teeth of a row may extend, at least in part, in alternation on either side of a geometrical dividing surface, being offset on either side of the surface.

At least two teeth of a row may present touching or spaced-apart bases. At least two consecutive teeth of a row may form between them a V-shaped groove when the applicator is observed along a direction that is substantially perpendicular to the axis of the row, or, in a variant, that is substantially parallel to the axis of the row.

The configuration of the teeth could be selected as a function of the makeup effect to be achieved, e.g. made up to a heavier or lighter extent.

At least three teeth of a row may optionally be evenly spaced along the axis of the row.

The applicator may comprise at least a first row of teeth, and a second row of teeth, the first row comprising at least three teeth following one another at a first spacing, and the second row comprising at least three teeth following one another at a second spacing.

The first spacing may be equal to the second spacing, or it may be different therefrom. The first and second rows may be carried by the same branch member or by two different branch members.

The teeth may present various shapes, in particular they may be elongate in shape, e.g. a peg shape that is cylindrical of optionally-circular cross section, conical, frustoconical, or pyramidal, of optionally rectilinear longitudinal axis. Teeth may present rounded free ends. Teeth may be generally flat in shape, with an elongate cross-section along a long axis that is substantially perpendicular to the longitudinal axis of the branch member that carries the teeth under consideration, for example.

By way of example, in cross-section, the teeth may have a long transverse dimension that is greater than or equal to 0.2 mm, e.g., greater than or equal to 0.5 mm, being different from flocking bristles. For example, when the teeth are cylindrical pegs, their diameter may be greater than or equal to 0.2 mm.

The applicator may comprise teeth that are made of the same material as the support structure, in particular of the same material as the branch members and/or of the main support.

The main support, the branch members, and the teeth may be made as a single piece by molding (e.g., injection molding) or in some other way.

The applicator may comprise at least one tooth that is made of a material that is different from the material of the support structure.

By way of example, the teeth may be made by injection molding onto the support structure a material that is different from the material of the support structure, e.g. a material of different flexibility.

The main support and/or at least one branch member and/or the teeth may be made entirely out of polyethylene terephthalate (PET), polyoxymethylene (POM), polyamide (PA), polystyrene (PS), polypropylene (PP), or polyethylene (PE), this list not being limiting.

The main support and/or at least one branch member and/or the teeth may be made entirely of a flexible or elastomer material, in particular a silicone rubber, or a nitrile rubber; ethylene-propylene terpolymer rubber (EPDM), ethyl vinyl acetate (EVA), polyvinyl chloride (PVC), polyurethane (PU), latex, or butyl rubber; or a thermoplastic elastomer, SANTOPRENE®, in particular with copolymers of terephthalate, butene, and stratified polytetramethyleneoxide glycol; Hytrel®, with block amide polyethers; Pebax®; this list not being limiting.

The support structure and/or the teeth may include magnetic or magnetizable particles.

The main support and the branch members may be made as a single piece by molding thermoplastic material.

The applicator may comprise a stem to which the support structure, particularly, the main support, may be fastened.

The support structure may be fitted onto the stem, or, in a variant, it may be made integrally with the stem. It may be molded with the stem or overmolded onto the stem in a different material.

A thickness of the support structure, measured in side view, may be less than or equal to a greatest transverse dimension of the stem.

The stem may be connected, at its end remote from the support structure, to a closure cap for closing, in a leak-tight manner, a receptacle containing the composition for application. The stem may comprise at least one elastically-deformable flexible portion, thereby making it possible to modify the orientation of the applicator member relative to the closure cap, for example.

The stem may present a longitudinal axis that coincides with the longitudinal axis of the support structure. In a variant, the support structure may present a longitudinal axis that is parallel to, but offset from, the axis of the stem, or that forms a non-zero angle therewith.

The stem may comprise a narrowing, e.g. a narrowing that comes to be positioned at the wiper member when the applicator is in place on the associated receptacle.

In another aspect, independent from, or in combination with, one or more of the examples discussed above, the applicator may comprise an open-work support structure having a shape that is substantially flat and elongate along a longitudinal axis, and that defines first and second opposite main faces. The applicator may also comprise at least three rows of teeth extending from the first main face, with each row comprising at least three teeth, the rows extending obliquely relative to the longitudinal axis and being spaced apart along the longitudinal axis. In addition, the applicator may comprise at least three rows of teeth extending from the second main face, with each row comprising at least three teeth, the rows being spaced apart along the longitudinal axis.

The rows of the first face may be superposed on the rows of the second face when the support structure is observed from above, in a direction that is perpendicular to the main faces.

In a variant, the axes of the rows of the first face may cross over the axes of rows of the second face when the support structure is observed from above.

In another aspect, independent from, or in combination with, one or more of the examples discussed above, the applicator may comprise an applicator member that is elongate along a longitudinal axis, and that presents a generally flat cross-section. The applicator may also include at least five teeth, e.g., at least 100 teeth, disposed on at least one face of the applicator member. The teeth may be positioned with a density that is greater than or equal to ten teeth per $cm^2$, e.g., greater than or equal to 20 teeth per $cm^2$ or greater than or equal to any integer lying in the range of 10 to 100 teeth per $cm^2$.

The applicator member may comprise a support structure, including teeth, and optionally having open-work cavities passing therethough. The open-work cavities may be distributed substantially uniformly over the applicator, e.g., with the number of open-work cavities and/or the density of open-work cavities being as mentioned above. In some embodiments, the open-work cavities may be distributed regularly.

The applicator member may comprise teeth that extend from a single face or from two opposite faces.

The teeth may be disposed in rows, e.g. in rows that are parallel to one another, and that may extend obliquely relative to the longitudinal axis of the applicator member so that rows may pass through the longitudinal axis of the applicator when the applicator is observed from above. The number of rows is as indicated above, for example.

The height of the teeth may decrease at the ends of at least one row of teeth, or of each row of teeth.

The height of the teeth may decrease at the proximal and distal ends of the applicator member when the applicator is observed from the side.

An envelope surface of the applicator member may present a convex longitudinal section, at least for the portion of the envelope surface defined by the free ends of the teeth, when the applicator is observed from the side.

An envelope surface of the applicator member may be generally symmetrical about a mid-plane that contains the longitudinal axis of the applicator member, and that intersects the applicator member mid-way through its thickness, for example.

In another aspect, independent from, or in combination with, one or more of the examples discussed above, an applicator for applying a composition to eyelashes or eyebrows may be provided. The applicator may comprise a stem and an applicator member at one end of the stem. The applicator member may comprise a plurality of rows of teeth extending substantially parallel to one another and obliquely relative to a longitudinal axis of the applicator member, the rows extending from top to bottom and from left to right when the applicator member is observed from above with the stem situated on the right-hand side.

The rows of teeth may extend from a support structure that is substantially flat.

Most of the rows may comprise at least three teeth, e.g., at least four teeth.

In another of its aspects, an applicator device for a composition comprising makeup or a care product for application to eyelashes and/or eyebrows may be provided. The device may comprise any of the applicators as described herein, and the composition for application to eyelashes or eyebrows.

The device may further comprise a receptacle containing the composition.

The receptacle may comprise a wiper member.

The receptacle may be arranged so as to force the composition to flow through open-work cavities of the applicator member when a manipulator member is actuated.

In another aspect, the present disclosure is directed to a method of applying a composition to eyelashes or eyebrows. The method may comprise loading any one of the applicators described herein with composition and applying the composition to eyelashes and/or eyebrows.

The applicator member may be loaded with composition in such a manner that its open-work cavities, if any, are filled with composition. In some cases, the open-work cavities may be completely filled with composition.

While loading the applicator with composition, the composition may be forced to flow through the open-work cavities. The composition may also be mixed by means of the applicator member, where appropriate.

The stem may be subjected to vibration by means of a vibrator, where appropriate.

BRIEF DESCRIPTION OF THE DRAWINGS

The disclosed device can be better understood by reading the following detailed description of non-limiting embodiments thereof, and by examining the accompanying drawings, which form an integral part of the description, and in which.

MORE DETAILED DESCRIPTION

Figure 1:
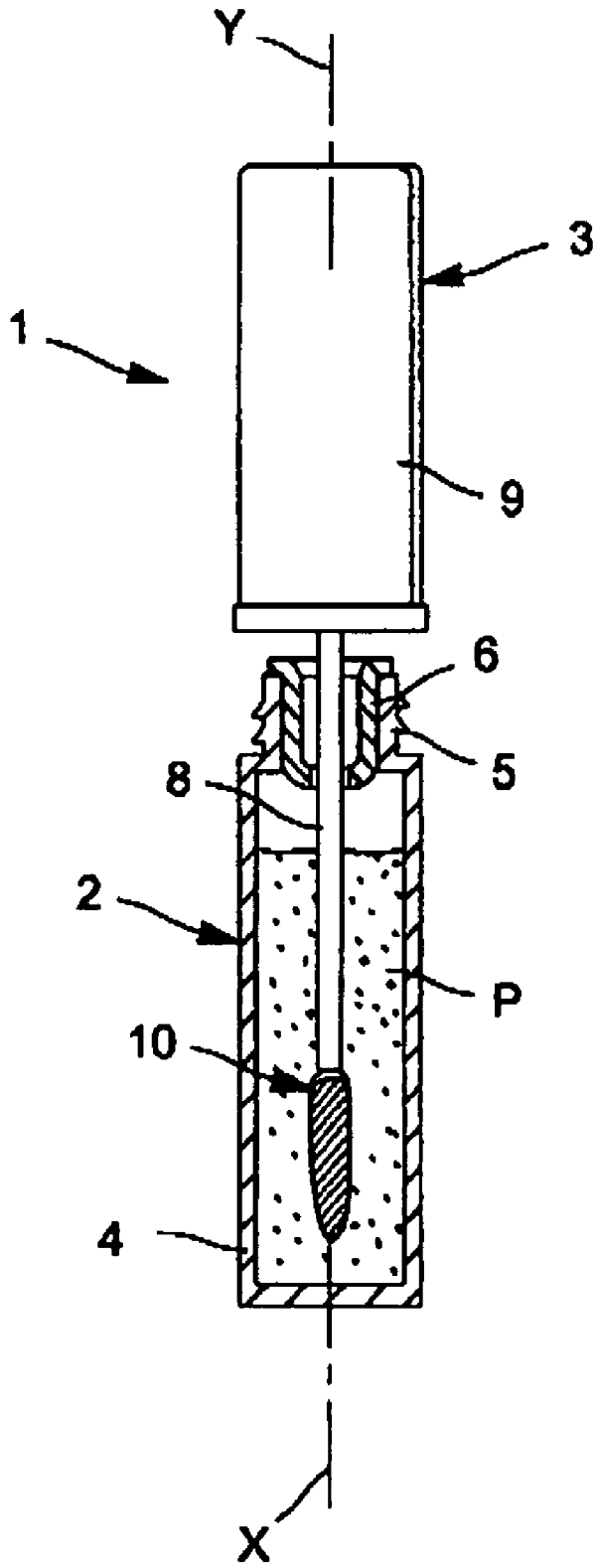
FIG. 1 is a diagrammatic and fragmentary longitudinal section of an example of a packaging and applicator device made in accordance with the invention.
Figure 3:
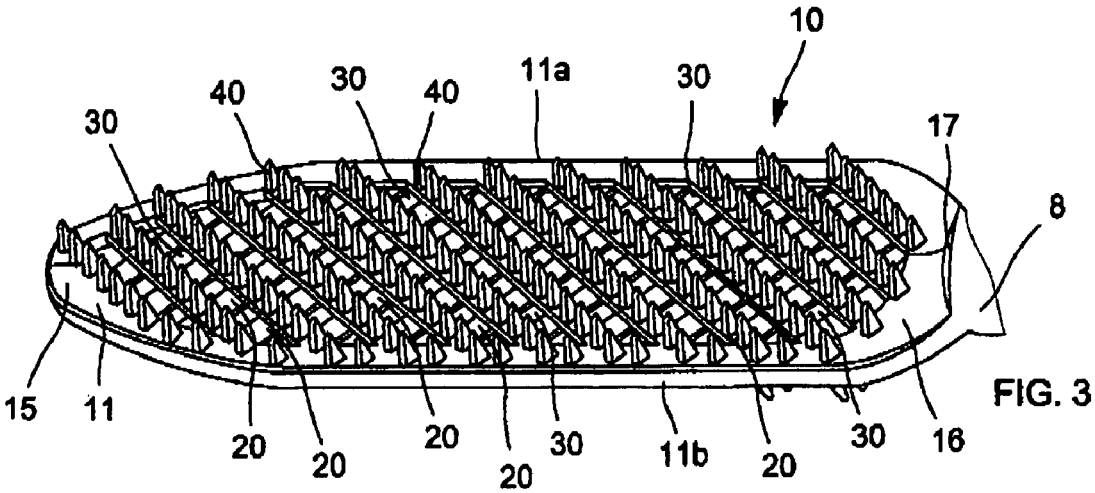
FIG. 3 is a perspective view of the applicator member.

The packaging and applicator device 1 shown in FIG. 1 comprises a receptacle 2 containing a composition P for application to eyelashes and/or eyebrows, in particular makeup, e.g. mascara or a care product, and an applicator 3 for applying the composition P.

In the embodiment shown in FIG. 1, the receptacle 2 comprises a body 4 provided with a neck 5 in which there is housed a wiper member 6.

The applicator 3 includes a single stem 8 that is connected at one end to a handle 9 that also constitutes a closure cap for closing the receptacle 2 in a leak-tight manner.

In the embodiment shown, the stem is cylindrical, of constant diameter, but it is not beyond the ambit of the invention for the stem 8 to include a narrowing, e.g. situated at the wiper member 6, and in particular at a lip thereof, so as not to deform it during storage when the receptacle 2 is closed.

The other end of the stem 8 carries an applicator member 10 that is shown in isolation in FIGS. 2 to 6 and that is described below.

By way of example, the wiper member 6 is adapted to wipe the stem 8 and the applicator member 10.

Depending on the shape of the applicator member 10, and on the material from which it is made, as well as the shape and the kind of wiper member 6, the applicator member 10 can optionally deform on passing through the wiper member 6.

By way of example, it is possible to select the wiper member 6 as a function of the quantity of composition that it is desired to keep on the applicator member 10 after it has been withdrawn from the receptacle 2.

By way of example, in some embodiments, both the applicator member 10 and the wiper member 6 may deform while the applicator 3 is being withdrawn.

Figure 2:
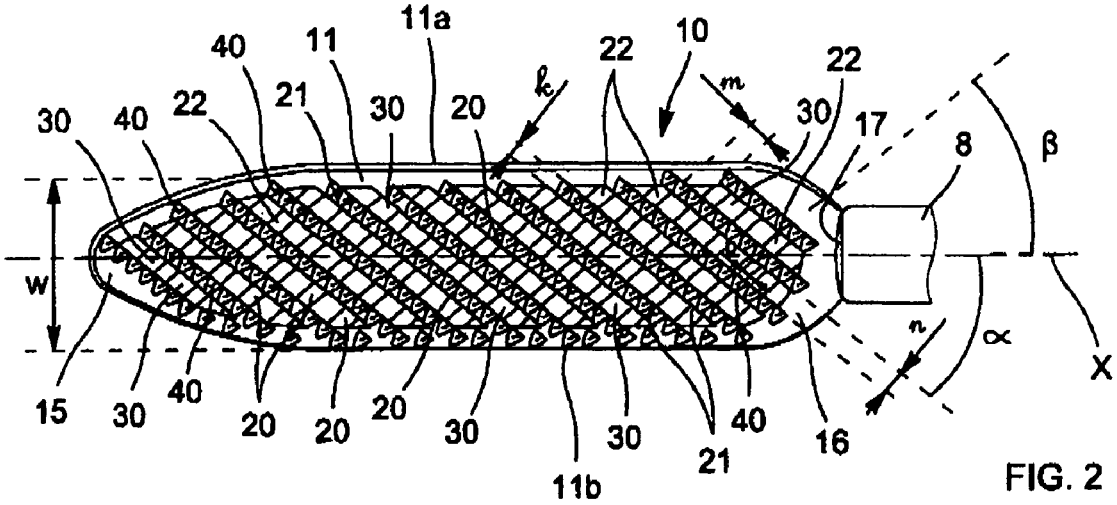
FIG. 2 is a plan view of the applicator member of the FIG. 1 device shown in isolation.

With reference to FIGS. 2 to 6, it can be seen that the applicator member 10 includes a support structure comprising a main support 11 and branch members 20 that are situated within the main support 11 when the applicator member is observed from above, as in FIG. 2.

As also shown in FIG. 2, the main support 11 may have a generally elongate shape along a longitudinal axis X, which may, as in this embodiment, coincide with the longitudinal axis Y of the stem 8.

In the embodiment under consideration, the main support 11 is in the form of a frame having two lateral sides 11*a* and 11*b* that are parallel to the longitudinal axis X, for example.

The distal portion 15 of the main support may taper, as shown, so as to make it easier for the applicator member 10 to be returned into the receptacle.

As shown in this embodiment, the proximal portion 16 of the main support 11 may be connected to an endpiece 17 for fastening to the stem 8 by, for example, being inserted into a housing of the stem. Fastening can be performed by heat-sealing, by snap-fastening, by force-fitting, by crimping, and/or by adhesive, for example.

The proximal portion 16 of the main support 11 may taper towards the endpiece 17, so as to make it easier for the applicator member to pass through the wiper member 6. The endpiece 17 for fastening the support to the stem can be connected to the flat portion of the support structure via rounded fillets 17*a*, as can be seen in particular in FIG. 4.

In one embodiment, the main support 11 may be made integrally with the stem 8, e.g. by molding a plastics material.

In some embodiments, the main support 11 presents a substantially flat shape having a maximum thickness e that can be substantially constant over more than half the length of the support, e.g., over substantially the entire visible length of the support, as shown.

By way of example, the visible length L of the applicator member 10 may be in the range of 10 mm to 40 mm.

In this embodiment, the branch members 20 form an open-work structure.

The branch members 20 comprise a first set of branch members 21, and a second set of branch members 22.

In the embodiment under consideration, each of the branch members 21 of the first set extends obliquely relative to the longitudinal axis X when the applicator member is observed from above, as in FIG. 2, being oriented from right to left and from bottom to top, for example.

By way of example, the branch members 22 of the second set are oriented obliquely relative to the longitudinal axis X in such a manner as to cross over the branch members 21 when the applicator member 10 is observed from above, the branch members 21 and 22 forming a grid structure that defines open-work cavities 30 passing through the support structure.

In the embodiment under consideration, the branch members 21 are parallel to one another, forming an angle $\alpha$ that is in the range of 30° to 60° with the axis X, for example. The branch members 21 are spaced apart from one another at substantially regular pitch of length n.

By way of example, the branch members 22 are parallel to one another and are oriented with an angle $\beta$ relative to the axis X that is equal to, for example, the angle $\alpha$, (e.g., close to 40°).

The above angle values $\alpha$ and $\beta$ can also apply to the longitudinal axes of the corresponding rows.

The distance m between two adjacent branch members 22 is equal to the above-mentioned distance n.

The number of branch members 21 and 22 and their disposition are such that the open-work density 30 $cm^2$ is in the range of 2 to 120, for example.

When the applicator member 10 is observed in plan view, as in FIG. 2, the width k of a branch member 21 or 22 is in the range of 0.5 mm to 2 mm, for example.

Figure 6:
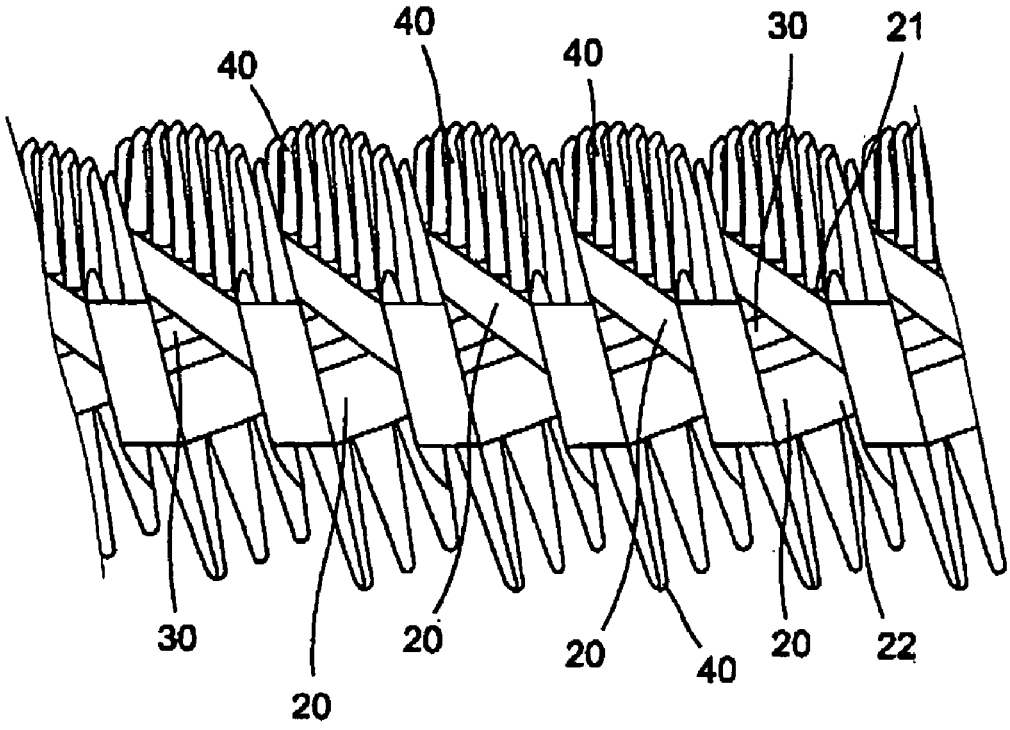
FIG. 6 shows an embodiment detail of the applicator member in FIGS. 2 to 5*a;*

In the embodiment under consideration, the branch members 21 extend over the branch members 22, as can be seen in FIG. 6, thereby making it easier to mold the grid structure formed in this way and to create cavities that are suitable for retaining the composition.

By way of example, the branch members 21 and 22 have a thicknesses, measured perpendicularly to the plane in FIG. 2, that correspond substantially to half the thickness e of the main support 11. As shown, in some embodiments, the total sum of the respective thicknesses of the branch members 21 and 22 does not exceed the maximum thickness of the support structure.

The width w of the main support 11 is in the range of 3 mm to 15 mm, for example.

By way of example, the thickness e is less than a greatest transverse dimension d of the stem 8, in particular its diameter for a stem of circular section.

At least one of the branch members 21 and 22 includes a row of teeth 40, the teeth 40 following one another along the longitudinal axis of the branch member in question at a regular pitch, for example. The distance p measured between the tips of the teeth along the row is in the range of 0.5 mm to 3 mm, for example.

As shown, the axis of a row of teeth extending along a branch member 21 or 22 coincides with the axis of the branch member. In other embodiments, however, it is possible to have a row of teeth extending along an axis that forms an angle with the longitudinal axis of the corresponding branch member. In some embodiments, the angle may be less than 30°, for example, e.g., less than 20° or less than 10°.

In the embodiment shown, all of the branch members 21 include a row of teeth and the same applies for all of the branch members 22. In other embodiments, however, teeth could be included in only one set of branch members. For example, in some embodiments, teeth could be included on the branch members 21 only, with the branch members 22 not including any teeth.

In some embodiments, the applicator could include only branch members 21 that are not connected together other than at their ends.

Figure 6A:
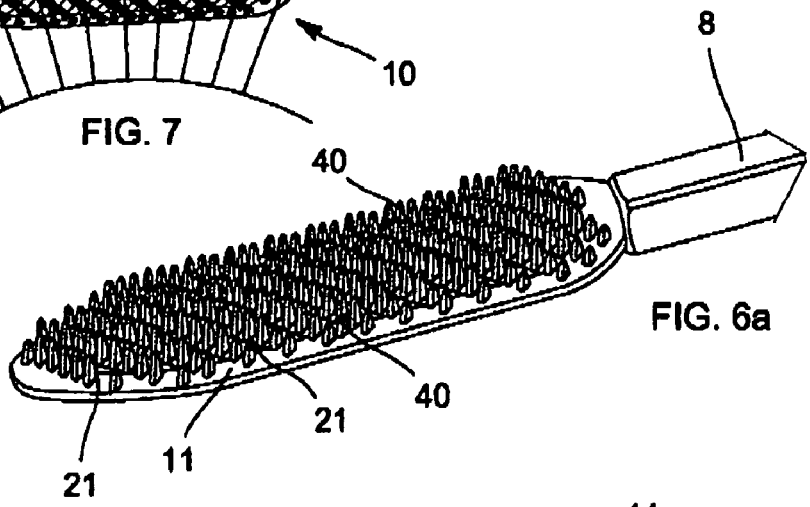
FIG. 6*a* is a perspective view of a variant embodiment.
Figure 6B:
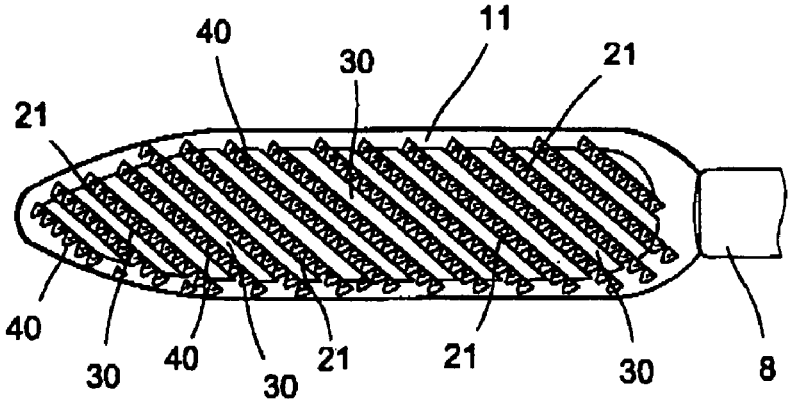
FIG. 6*b* is a plan view of the FIG. 6*a* applicator member.

By way of example, FIGS. 6*a* and 6*b* show a variant embodiment that differs from the applicator in FIGS. 1 to 6 by the fact that it does not have branch members 22 crossing over the branch members 21.

Teeth 40 extend outwards from the branch members 21 on a single main face 10*a* of the support structure.

The open-work cavities 30 formed between the branch members 21 have an elongate shape in this embodiment.

Figure 4:
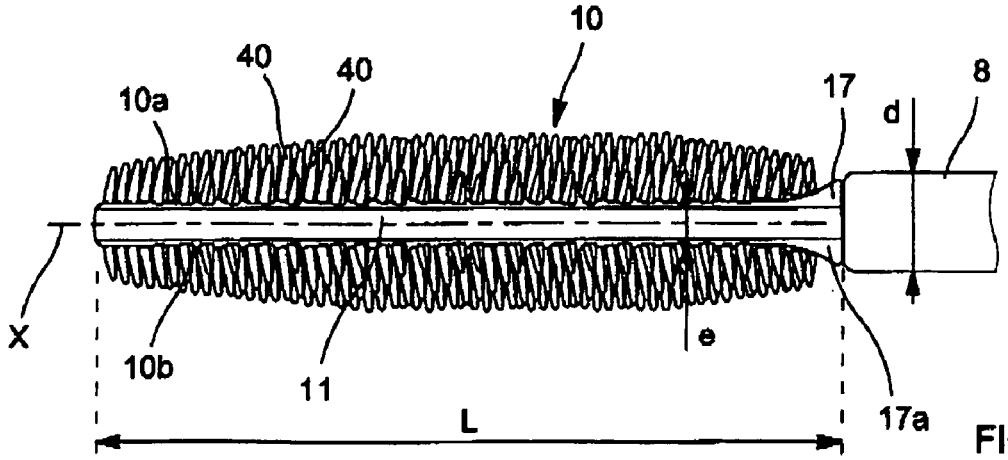
FIG. 4 is a side view of the applicator member.
Figure 5:
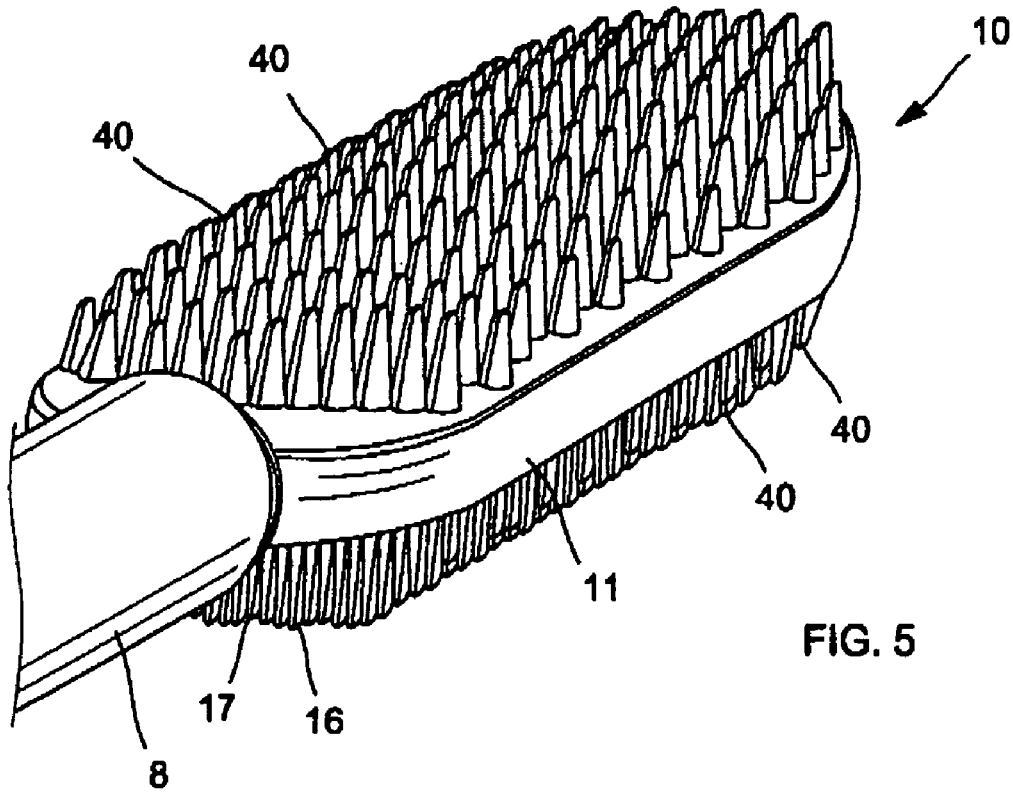
FIG. 5 is another perspective view of the applicator member.

The applicator member 10 shown in FIGS. 1 to 6 includes a first set and a second set of teeth that extend from opposite main faces 10*a* and 10*b* respectively of the support structure, as can be seen FIG. 4.

The distance p between the tips of two consecutive teeth is the same for all of the rows of teeth of one face, or of both faces, but, in variants not shown, the distance can vary.

Where appropriate, the teeth of one row can have touching bases.

In the embodiment under consideration, all of the teeth extending from one face of the support structure extend in a single direction that is perpendicular to a mid-plane of the support structure, the mid-plane being parallel to the plane in FIG. 2.

The height of the teeth 40 can vary as a function of the location of each tooth on the applicator member.

Figure 5A:
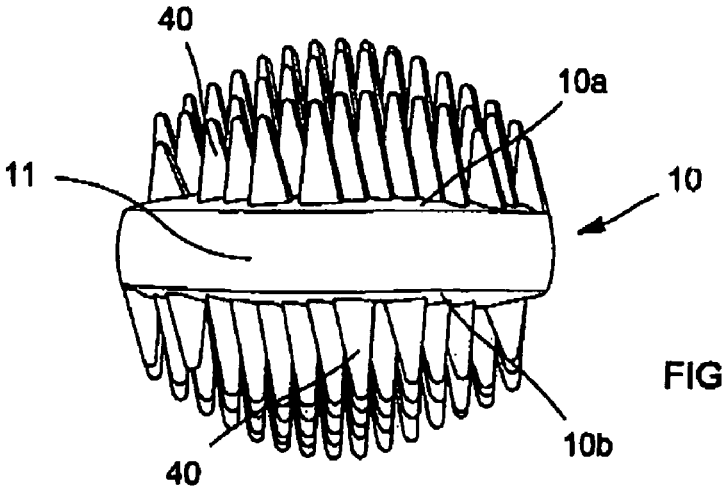
FIG. 5*a* is an end view along the longitudinal axis of the applicator member.

In the embodiment under consideration, the teeth of one row have heights that decrease towards the ends of the corresponding branch member, as can be seen in FIG. 5*a*. The heights of the teeth can also decrease towards the proximal and distal regions 16 and 15 of the main support 11, as can be seen in FIG. 4, thereby making it easier for the applicator member 10 to pass through the wiper member.

The envelope surface defined by the free ends of the teeth 40 extending along a face of the support structure can generally be convex about two axes, one being parallel to the longitudinal axis X, and the other being perpendicular to the longitudinal axis and parallel to the flat face of the support structure.

The number of teeth 40 on either face of the applicator member can be relatively high, e.g. in the range of 40 to 200.

Figure 7:
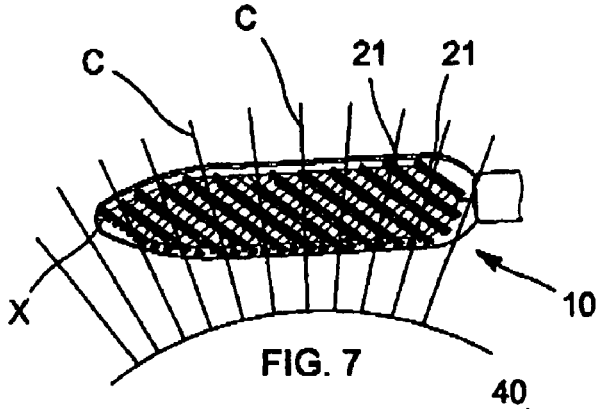
FIG. 7 shows the use of the applicator member in FIGS. 1 to 6 for making up eyelashes.

The applicator member 10 can be used after being withdrawn from the receptacle 2 by bringing the teeth 40 of one face into contact with eyelashes C, as shown in FIG. 7. The orientation of the rows of teeth may be oblique relative to the longitudinal axis X, and may go from right to left and from bottom to top, as shown in FIG. 7, on the face for coming into contact with eyelashes. This configuration may be advantageous as it may encourage and/or facilitate penetration and combing of eyelashes.

While the applicator member is in use, an eyelash C can come into contact simultaneously with teeth belonging to a plurality of consecutive rows.

In one embodiment, the applicator member 10 includes, on the side opposite from the face visible in FIG. 7, rows of teeth carried by the branch members 22 that cross over the rows carried by the branch members 21, such that when the applicator member is turned through half a turn, and regardless of whether the stem is on the left-hand or right-hand side, an orientation is obtained for the visible rows that is the same relative to eyelashes as the orientation shown in FIG. 7, thereby making it possible to make up both eyes in the same way.

In a variant embodiment, the applicator member includes, on its face opposite from the face visible in FIG. 7, rows of teeth that are superposed on the rows of teeth carried by the branch members 21 or that have axes that are parallel thereto.

In this embodiment, when the applicator member 10, is turned over, the orientation of the rows that come into contact with eyelashes changes, going from left to right and from bottom to top. This makes it possible to apply makeup in two different ways, depending on which face of the applicator member is used.

The support structure, and in particular the main support 11, can be given shapes other than the shapes shown in FIGS. 1 to 6, e.g. a shape wherein opposite sides 11*a* and 11*b* are not parallel.

Figure 8:
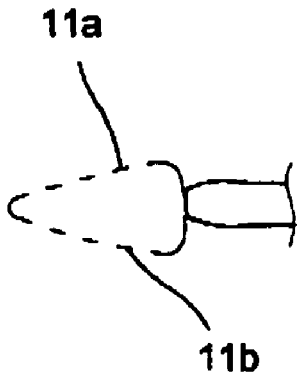
FIGS. 8 to 11 show various shapes for the main support.

By way of example, FIG. 8 shows the outline of an applicator member 10 in plan view, in which the support structure presents an outline that is generally triangular.

Figure 9:
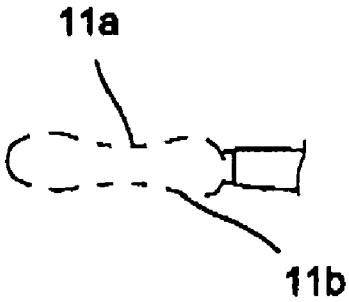

In FIG. 9, the support structure 11 presents a peanut shape in plan view, with two opposite concave sides 11*a* and 11*b*.

Figure 10:
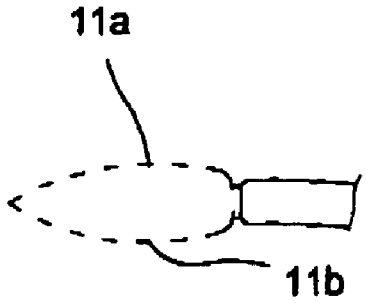
Figure 11:
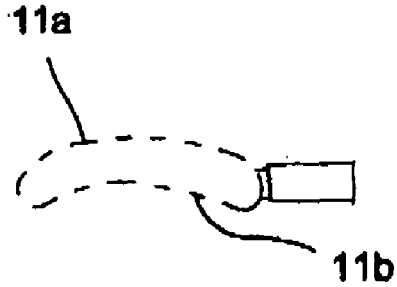

In the embodiment in FIG. 10, the sides 11*a* and 11*b* are outwardly convex, and in the embodiment in FIG. 11, the support structure is generally kidney-shaped, the sides 11*a* and 11*b* being convex and concave respectively.

The main support 11 can also have shapes other than the shapes shown.

FIGS. 12 to 17 show various envelope surfaces for the applicator member when observed in cross section in a plane that is transverse to its longitudinal axis.

The envelope surface is defined, at least in part, by the free ends of the teeth, and where there are no teeth, by the outline of the support structure.

Figure 12:
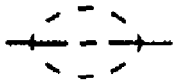
FIGS. 12 to 17 are cross-sections of various shapes for the envelope surfaces.
Figure 13:
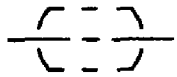
Figure 14:
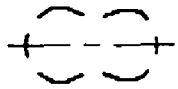
Figure 15:
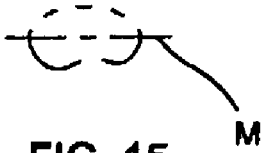

In the embodiment in FIG. 12, the envelope surface has, in cross-section, a shape that is generally lenticular. In the embodiment in FIG. 13, the envelop surface has a cross-sectional shape that is generally rectangular. In the embodiment in FIG. 14, the envelope surface has a cross-sectional shape that is generally peanut-shaped. In the embodiment in FIG. 15, the envelope surface has a cross-sectional shape having different profiles on either side of a mid-plane M of the support structure.

In some embodiments, the envelope surface can be symmetrical about the mid-plane M. In the embodiment in FIG. 16, the cross-section of the envelope surface is circular in shape. The applicator member can include an envelope surface that is cylindrical, or that is spherical, at least in part.

Figure 17:
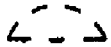
Figure 16:
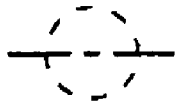

In the embodiment in FIG. 17, the applicator member presents teeth on only one side of the support structure, and the envelope surface of the applicator member has a cross-section in the shape of a half-moon.

Figure 18:
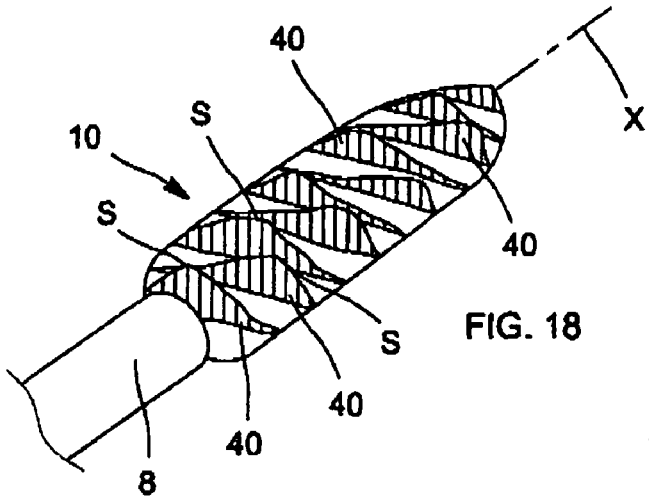
FIG. 18 is a diagram showing the possibility of having teeth having heights that vary within a row.

FIG. 18 shows the possibility of the rows of teeth having heights that vary along the rows.

By way of example, the heights can vary in such a manner that the high points of the curves joining the tips of the teeth in each row are situated alternately on opposite sides of the longitudinal axis X of the applicator member 10 when the applicator member is observed from above.

Figure 19:
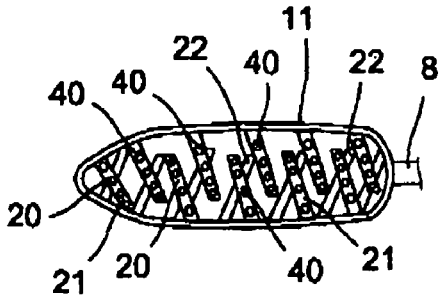
FIG. 19 is a plan view of an applicator member according to a variant embodiment.

In particular when the main support 11 is in the form of a frame, as shown in FIG. 19, the branch members 20 can be connected to the main support at one end only, with the other end of each branch member being free.

At least some of the branch members 21 can be connected together, as can be seen in this figure, by bridges of material that are constituted by other branch members 22, for example, which can optionally be connected to the main support 11.

Figure 20:
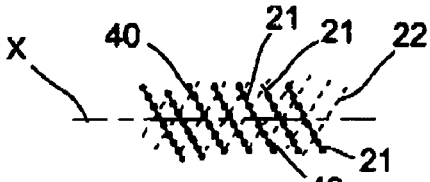

FIG. 20 is a diagram showing the possibility of the applicator member 10 including a plurality of branch members 21 carrying teeth and having substantially the same orientation relative to the longitudinal axis X, while other branch members 22 that co-operate with the branch members 21 to form a gridded support structure do not have any teeth.

When the support structure has a gridded shape when observed from above, the teeth can be carried by a grid of substantially constant thickness.

Figure 21:
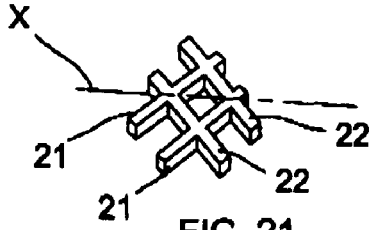
FIGS. 20 to 41 show various configurations for the support structure.

FIG. 21 shows branch members 21 and 22 that present the same thickness and that form such a grid, having longitudinal axes that intersect, and top and bottom faces at the same height. The open-work cavities of such a grid can be of various shapes, e.g. polygonal or circular.

Figure 22:
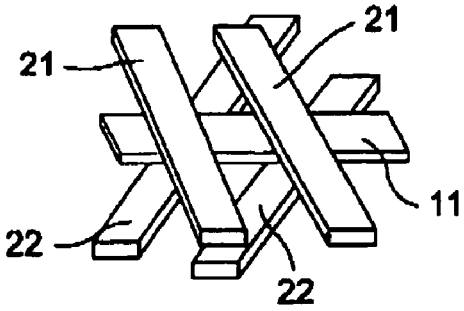

In a variant shown in FIG. 22, the branch members 21 and 22 can be spaced apart by a non-zero distance, e.g., a distance that is equal to the thickness of a main support 11 or of any other element of the support structure.

The support structure can carry teeth on one of its faces or on both of its faces. The teeth can be disposed in parallel rows on one face. On the other face, the teeth can be disposed along rows having axes that cross over the axes of the rows of the first face or that are parallel thereto.

Figure 23:
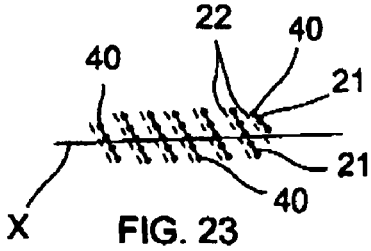

As illustrated in FIG. 23, in some embodiments the branch members 21 and the branch members 22 may be oriented parallel to one another, and obliquely relative to the longitudinal axis X. In some such embodiments the branch members 22 may be provided without teeth.

Figure 24:
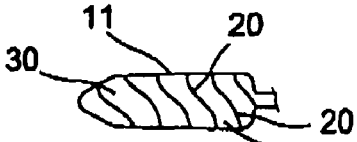

As shown in FIG. 24, in some embodiments, the applicator member may include at least some branch members 20 that are not rectilinear.

The applicator member can include branch members 20 that are substantially parallel to one another and not rectilinear.

In some embodiments, some, but not all of the branch members 20, may be parallel.

Figure 25:
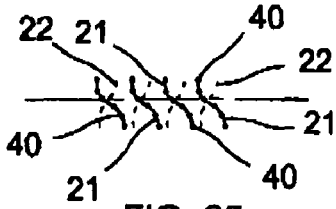

FIG. 25 shows an exemplary embodiment, in which the applicator member includes a first set of branch members 21 that are parallel to one another, and a second set of branch members 22 co-operating with the branch members 21 to form intersections. In this embodiment, the branch members 21 and 22 are not rectilinear, extend generally transversally to the longitudinal axis X, and interconnect the two lateral sides of the main support 11.

Figure 26:
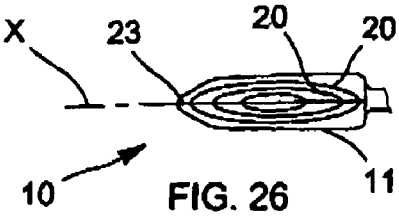

By way of example, in the embodiment in FIG. 26, branch members 20 extend around one another (i.e., in a concentric configuration) when the applicator member 10 is observed from above, e.g. being connected together via a branch member 23 that extends substantially parallel to the longitudinal axis X of the applicator member, for example. The branch member 23 may include teeth.

In this embodiment, the branch members 20 may include teeth on one side only or, in a variant, on both sides.

Figure 27:
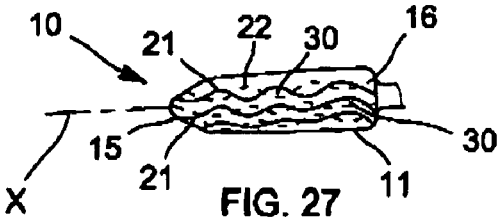

In the embodiment in FIG. 27, the support structure includes a first set of branch members 21 that generally extend along the applicator member, having an undulating shape with teeth on one side, e.g., the side that is visible when the applicator member is observed from above, as in FIG. 27.

In this embodiment, the support structure can also include a second set of branch members 22 that also have an undulating shape and that extend under the branch members 21, so as to co-operate therewith to form a gridded structure.

The branch members 22 can include teeth on the face of the support structure that is opposite from the face that is visible in FIG. 27.

The branch members 21 and 22 can be connected at their ends to the proximal and distal regions 16 and 15 of the main support 11.

Figure 28:
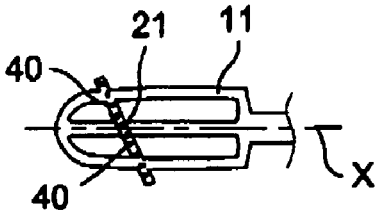

The support structure can also include one or more rows of teeth on one face of the support structure, included on at least one branch member 21, wherein the second face does not include any teeth, or possibly includes a second row of teeth 40 opposite from the first. The branch member(s) 21 can extend solely within the support structure or can project at each end out from the main support 11, as shown in FIG. 28. In this figure, only one branch member is shown, for the purpose of clarity of the drawing.

Figure 29:
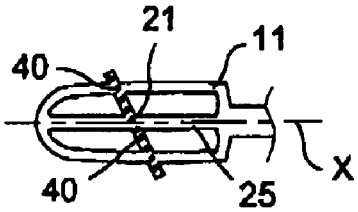

In a variant embodiment, the support structure can also include one or more central longitudinal branch members 25 that do not have any teeth, as shown in FIG. 29, and one or more oblique branch members, with only one branch member being shown for the purpose of clarity of the drawing.

Figure 30:
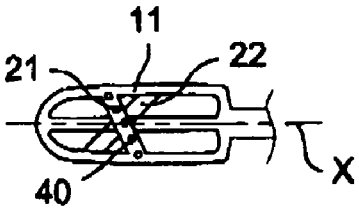

In another variant, the support structure can include at least one second branch member 22 on the opposite face, that can have at least one branch member 21 crossing over it, for example, as shown in FIG. 30.

Figure 31:
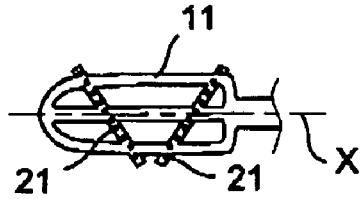

FIG. 31 shows an embodiment in which the support structure includes at least two branch members 21, each carrying a row of teeth, wherein the rows of teeth do not extend parallel to each other, and wherein the branch members 21 project by their ends out from the main support 11 of the support structure. The branch members 21 can be oriented in opposite directions, as shown.

Figure 32:
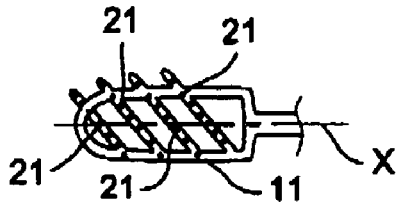

As shown in FIG. 32, a support structure can include a plurality of branch members 21 each having one end that projects beyond the main support 11, on one side of the support structure.

Figure 33:
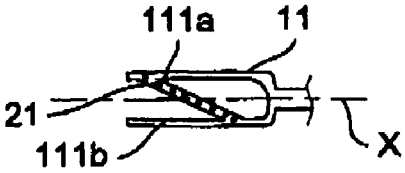
Figure 34:
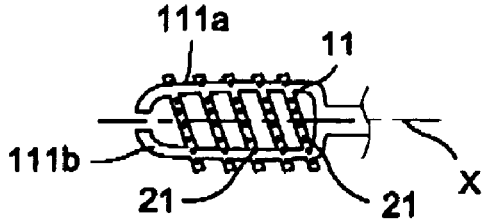

As shown in FIGS. 33 and 34, the main support 11 of the support structure need not be constituted by a closed frame, but may, for example, comprise two opposite branches 111*a*, 111*b* that are not interconnected at end of the support structure.

The support structure can include a single branch member as shown in FIG. 33, or a plurality of branch members as shown in FIG. 34. As shown in FIG. 34, the branches 11*a* and 11*b* may be curved towards each other at their free ends.

Figure 35:
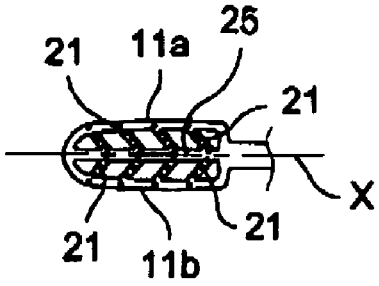

The branch members 21 of the support structure can also form, within the support structure, branch members 21 that extend from a central branch member 25 towards opposite edges 11*a*, 11*b* of the main support of the support structure, as shown in FIG. 35.

Figure 36:
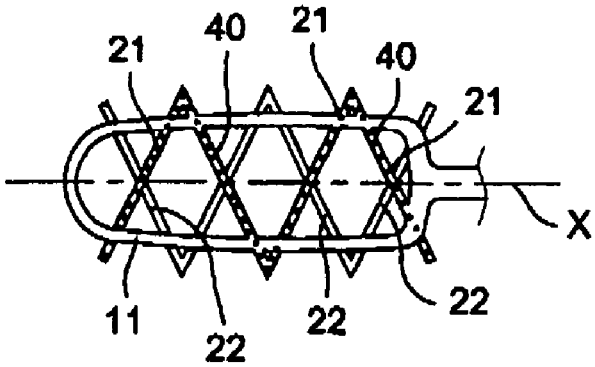

FIG. 36 shows another variant in which the support structure includes branch members 21 that are disposed in a zigzag configuration on a first face of the support structure, and opposite branch members 22 that are also disposed in a zigzag configuration so as to cross over the first branch members 21, wherein the branch members 21 and/or branch members 22 include teeth 40.

In a variant, the branch members 21 and 22 can extend in the same plane.

Figure 37:
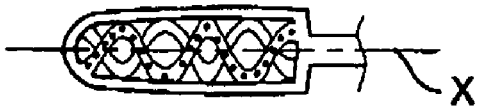

The branch members 21 and/or 22 can also be curvilinear, as shown in FIG. 37, for example. Each of the branch members can thus include a curvilinear row of teeth extending, at least in part, obliquely relative to the longitudinal axis X of the support structure.

Figure 38:
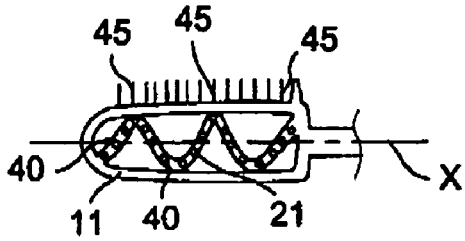

The main support 11 of the support structure can also include teeth 45 extending perpendicularly to the longitudinal axis X of the support structure, as shown FIG. 38.

Figure 39:
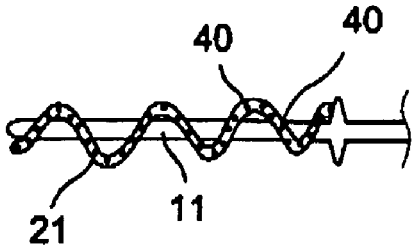
Figure 40:
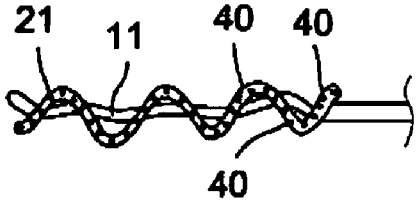

At least one curvilinear branch member 21 can also be carried by a main support 11 that is in the form of a central core, the core being rectilinear as shown in FIG. 39, or curvilinear as shown in FIG. 40.

The branch members 21 and 22 can have similar or different shapes on each of the faces of the applicator member.

Figure 41:
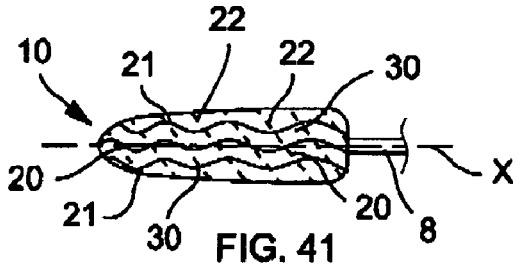

For example, one of the branch members 21 and 22 can present a rectilinear shape, and the other of the branch members 21 and 22 can present an undulating shape, as shown in FIG. 41. In such an embodiment, the applicator member can include teeth on a single one of its faces, or, in a variant, on both of its faces.

Naturally, still other forms of branch members could be envisaged without going beyond the ambit of the present invention.

In particular, in a variant not shown, the branch members are formed by the bridges of material that exist between the holes of a perforated membrane carrying the teeth on at least one of its faces.

In some embodiments, teeth can be connected to the corresponding branch member, substantially perpendicularly thereto, the teeth being oriented in a direction that is perpendicular or substantially perpendicular to a mid-plane of the support structure, for example.

In some embodiments, the teeth do not extend over the open-work cavities when the applicator member is observed in plan view, as in the embodiment in FIG. 2.

Figure 42:
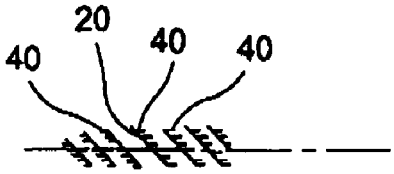
FIGS. 42 and 43 show examples of how the teeth can be positioned relative to the support structure.
Figure 43:
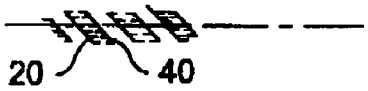

In other embodiments, the teeth can be made in such a manner as to extend, at least in part, over the open-work cavities 30 when the applicator member is observed in plan view, as shown diagrammatically in FIGS. 42 and 43.

For example, as shown in FIG. 42, when the applicator member is observed in plan view, it can be seen that the teeth 40 can be oriented towards the proximal end or towards the distal end of the applicator member.

The embodiment in FIG. 43 shows the possibility of the teeth associated with pairs of branch members being oriented towards one another when the applicator member 10 is observed in plan view.

The teeth belonging to two adjacent branch members and directed towards one another may be not interleaved when the applicator member is observed in plan view.

The support structure can present a flat shape in cross-section.

Figure 44:
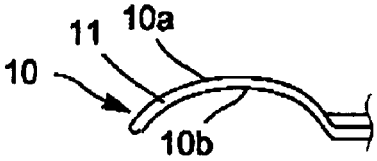
FIG. 44 is a side view of an example of a shape for a branch member.

The support structure can be completely flat or it can have a different shape, in particular curved, as shown diagrammatically in FIG. 44. For example, the support structure can include a main face 10*b* that is generally concave, e.g. having a curve adapted to the curve of a set of eyelashes.

Figure 45:
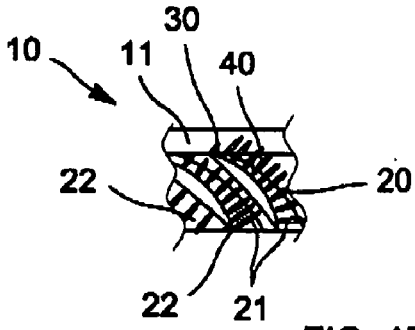
FIG. 45 is a diagrammatic and fragmentary perspective view of a variant embodiment.

FIG. 45 shows the possibility of the branch members 20 presenting a convex shape, e.g. forming an arch between the opposite lateral sides of the main support 11.

The teeth 40 included on a branch member that is convex in this way can be oriented locally along the normal to the branch member.

The free ends of the teeth 40 can define a curve that can optionally be parallel to the axis of the branch member.

In a variant embodiment, the branch members 22 can be convex with a concave side that is situated on the same side as that of the branch members 21. In such an embodiment, the branch members 21 and 22 may touch each other only at the main support 11.

Figure 46:
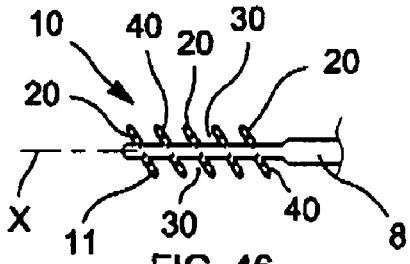
FIGS. 46 and 47 are plan views showing variant embodiments of the applicator member.

In some embodiments, the main support 11 can, as an alternative to being in the form of a frame, be in the form of a central core, as shown in FIG. 46. In such an embodiment, the branch members 20 may extend on either side of the main support 11 when the applicator member is observed from above.

In this embodiment, the branch members 20 may have at least one free end. This figure does not show all of the teeth 40 that may be included on the branch members 20, for the purpose of clarity of the drawing.

In addition, in this embodiment, all of the branch members 20 may have substantially the same orientation relative to the longitudinal axis X. By way of example, the applicator member may be made integrally with the stem 8 by molding.

Figure 47:
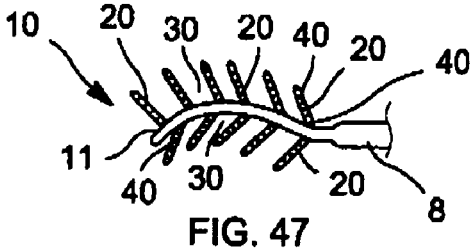
Figure 48:
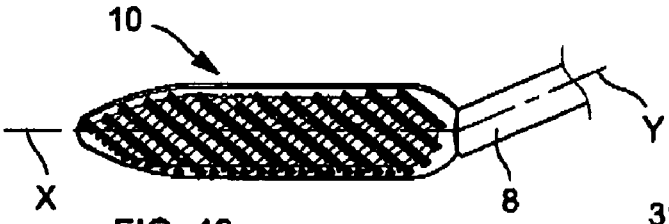
FIG. 48 shows how the longitudinal axis of the applicator member can form an angle with the longitudinal axis of the stem.

In the variant shown in FIG. 47, the main support 11 has a curved shape when the applicator member 10 is observed from above. FIG. 48 shows the possibility of the longitudinal axis X of the applicator member 10 forming an angle with the longitudinal axis Y of the stem 8, the angle being in the range of 5° to 50°, for example.

Figure 49:
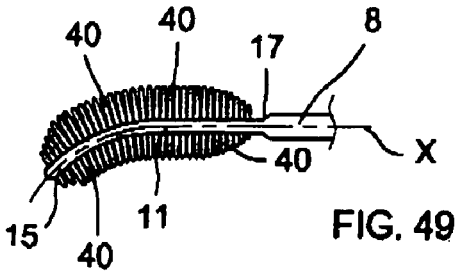
FIG. 49 is a side view of a variant embodiment of an applicator member.

In the variant shown in FIG. 49, the support structure includes a proximal portion that forms an angle with the distal portion.

The proximal portion of the support structure is coaxial with the axis of the stem 8 and the distal portion forms an angle with the proximal portion when the applicator member is observed from the side.

The main support can optionally include (e.g., carry) teeth. The embodiment in FIG. 2 shows the possibility of the main support 11 including teeth. For example, as shown in FIG. 2, the main support 11 may include teeth on one side, the teeth concerned being oriented parallel to the other teeth carried by the branch members.

The main support can also include teeth over its entire periphery, e.g. teeth disposed between the end teeth of the rows of teeth carried by the branch members 21, 22.

As shown in FIG. 38, the main support 11 can also include teeth that have an orientation other than the orientation of the teeth carried by the branch members 20. For example, on a lateral outside edge 11*a* or 11*b* (see FIG. 2) of the main support 11, it is possible to provide a set of teeth, stripes, or any other portion in relief that might be useful during application.

Figure 50:
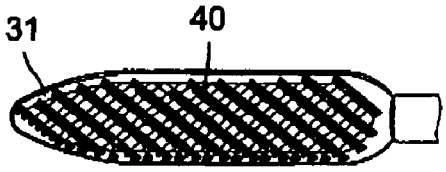
FIG. 50 is a plan view of a variant embodiment of an applicator member.

In the embodiment in FIG. 50, the main support 11 does not have teeth, the teeth extending solely on the branch members.

A row of teeth included on a branch member can comprise teeth that can be identical. The teeth can be of the same length or of different lengths, and optionally of the same cross-section, e.g. of the same diameter or of different diameters.

Figure 51:
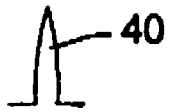
FIGS. 51 to 55 show examples of shapes for the teeth.

The teeth can have a shape that generally tapers towards their free ends, as shown in FIG. 51.

Figure 52:
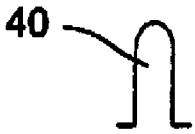

Over at least a fraction of their length, the teeth can also have a cross-section that is constant, with a rounded end, for example, as shown in FIG. 52.

In a variant not shown, each tooth can also include one or more bulges, or a ball at its free end.

By way of example, the teeth can be deformed while hot.

Figure 53:
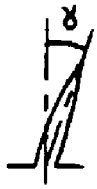

The teeth can be connected perpendicularly to the branch member, or they can form an angle γ with the branch member, as shown in FIG. 53.

Figure 54:
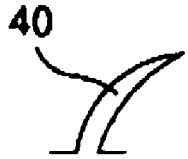

In some embodiments, at least a fraction of the teeth can be curved with a curvilinear longitudinal axis, as shown in FIG. 54. In such embodiments, the teeth may be connected perpendicularly to the branch member.

Figure 55:
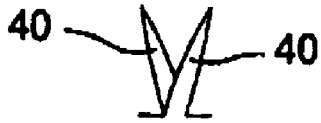

A branch member can include a succession of teeth that extend alternately in opposite directions, for example, as shown in FIG. 55, wherein the bases of the teeth being in alignment on the branch member.

Within any one row, the teeth can be disposed in any of the ways disclosed in U.S. Patent Application Publication Nos. 2002/0020424 A1, 2001/0047808 A1, and 2001/003785 A1, or in U.S. Pat. Nos. 6,581,610; 6,546,937; 6,539,950, 6,446,637; and 6,412,496.

In order to use the device 1, the user withdraws the applicator 3 from the receptacle 2.

The extent to which the open-work cavities 30 can be filled with composition depends on the rheology of the composition P, on the kind of wiper member 6, and on the dimensions of the open-work cavities 30. In some cases, open-work cavities 30 may be filled completely.

It can be advantageous for the open-work cavities 30 to be filled completely with composition P, since that can enable eyelashes to be well loaded, and can enable a relatively large reserve of composition to be constituted, e.g. for making up both eyes.

By way of example, the composition could be applied as shown in FIG. 7.

The wiper member 6 can be of any type, and can, for example, include a flexible lip defining at its bottom end a circular orifice of diameter substantially equal to the diameter of the stem 8. In a variant, the wiper orifice can have a different diameter and/or a shape that is not circular.

Without limitation, the wiper member 6 can be made of a plastics material, e.g. polyethylene (PE), polypropylene (PP), polyoxymethylene (POM), polyethylene terephthalate (PET), nitrile rubber, silicone rubber, ethylene-propylene terpolymer rubber (EPDM), styrene-isoprene-styrene (SIS), or styrene-ethylene-butylene-styrene (SEBS); a thermoplastic polyester elastomer such as that known under the trade name HYTREL®; or a thermoplastic elastomer such as that known under the trade name SANTOPRENE®), for example.

In some embodiments, the wiper member 6 may not be fitted to the neck. In other embodiments, however, the wiper member 6 could be molded or overmolded on the neck.

Figure 56:
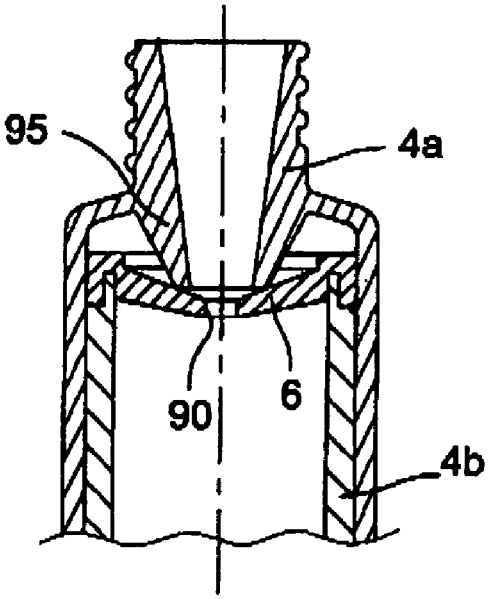
FIG. 56 shows an example of a device having a variable wiper member.

Regardless of the applicator member used, the associated wiper member 6 can be disposed in a receptacle having a body that can comprise two portions 4*a* and 4*b* that are suitable for being displaced relative to each other in such a manner as to cause the diameter of the opening 90 of the wiper member 6 to vary, as shown in FIG. 56.

In the embodiment in FIG. 56, the wiper member 6 is deformed by means of an extension 95 of the neck of the receptacle, but the invention is not limited to a particular arrangement of the wiper member 6, nor to its deformability, nor to a particular way of varying its cross-section through which the applicator member passes.

Figure 57:
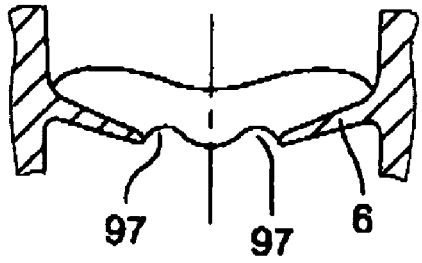
FIG. 57 is a diagram in axial section showing an example of a wiper member.

FIG. 57 shows the possibility of the wiper member 6 including an undulating wiper lip that can be deployed when the applicator member passes therethrough. By way of example, the undulations 97 are alternately hollow and bulging in the circumferential direction.

The wiper member 6 could also comprise an opening and at least one slit being connected to the opening in a grazing manner, and extending over less than a complete revolution around the axis of the opening.

The wiper member 6 could also be different, and could be in the form of a block of foam.

Figure 58:
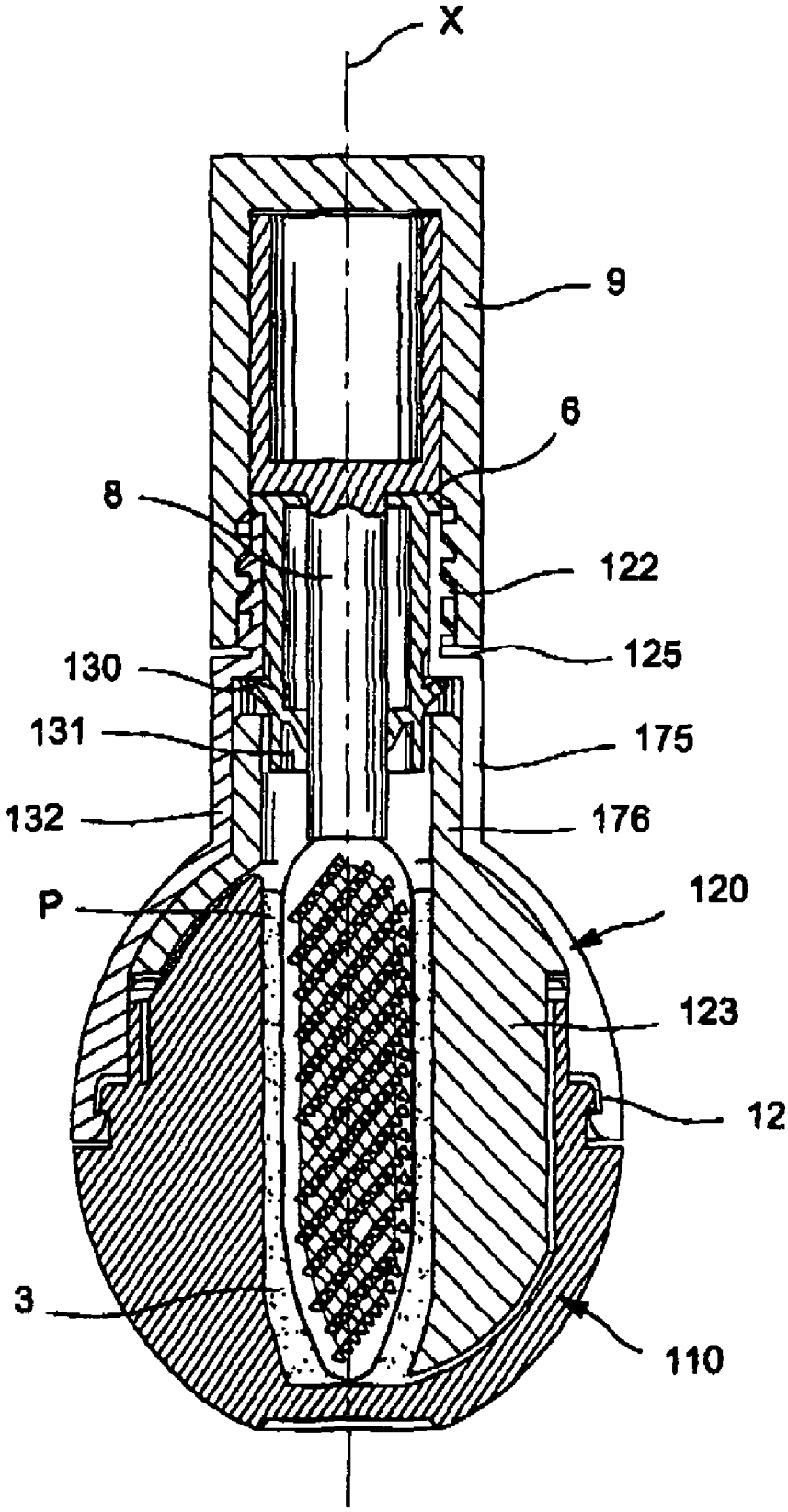
FIG. 58 shows a variant embodiment of the disclosed applicator member and an associated receptacle.

FIG. 58 shows a variant embodiment of the applicator device 100 including packaging.

The device 100 includes a receptacle comprising a first portion 110 and a second portion 120 that is suitable for turning relative to the first about an axis of rotation X that coincides with the longitudinal axis of the device 100 in the embodiment under consideration, as described in patent application EP-A2-1 584 260, the content of which is incorporated herein by reference.

The second portion 120 includes an outer portion 175 that includes an externally-threaded neck 122 on which the closure cap 9 can be screwed.

The bottom of the neck 122 is connected to a shoulder 125.

The wiper member 6 rests on the top edge of the neck and presents an annular holding lip 130 disposed below the shoulder 125.

The wiper member 6 includes a wiper lip 131 that extends inwards, and that, in the embodiment shown, in the closed position of the device, bears against the stem 8 of the applicator 3.

The outer portion 175 comprises a generally cylindrical portion 132 that extends downwards below the shoulder 125 and in register with the closure cap 9.

The cylindrical portion 132 can be internally fluted in such a manner as to make it easier to hold an inner portion 176 stationary in the outer portion 175, e.g. by clamping in the cylindrical portion 132.

The inner portion 176 includes a blade 123 in the example under consideration.

The characteristics of the various embodiments could be combined with one another in embodiments not shown.

The applicator device in FIG. 58 can be used with any applicator member made in accordance with the invention, and in particular with any applicator member described with reference to FIGS. 8 to 55.

Where appropriate, the main support can be made with the same thickness as at least one branch member, and the limit between the main support and at least one branch member need not be embodied by a sudden transition in the thickness of the support structure.

The applicator member can be made by molding a plastics material or it can be made in some other way, e.g. by cutting and/or stamping a metal sheet.

Where appropriate, the applicator member can include a plurality of materials, the teeth being made of a first material, for example, and the branch members and/or the main support being made of a second material that can be more or less rigid than the material from which the teeth are formed.

Where appropriate, the applicator member can be subjected, after molding, to an operation of mechanically treating the teeth, e.g. a grinding action, and/or by contacting the teeth with a hot or a cold surface. Examples of applicable methods of treating teeth are described in patent applications FR 2 852 500 and FR 2 850 549.

In a variant, the composition could be in the form of a cake, or it could be contained in a tube.

In any of the disclosed embodiments, the applicator could optionally be flocked at least in part.

When the receptacle includes a wiper member through which the applicator member is withdrawn, the applicator member can optionally be subjected to vibration while passing through the wiper member, thereby making it possible to wipe the applicator member in a way that is different than the way it is wiped when it is not vibrating. By way of example, the user can thus choose between at least two degrees of wiping the applicator member, depending on whether or not the applicator member is vibrating while passing through the wiper member.

The composition can also be applied by means of a device that is used to apply the composition, the device including: a removable fastener structure for fastening to at least one finger, a hand, or a wrist, or being hand held; and a vibration source that makes it possible to produce vibration.

For some aspects of the invention, the orientation of at least some rows of teeth may be perpendicular or parallel to the longitudinal axis X, instead of being oblique thereto.

The support structure can have teeth on one face or on two opposite faces, and the support structure can, in some embodiments, be an open-work structure.

The support structure can include teeth at a density that is relatively high, and open-work cavities at a density that is also relatively high, in particular with the values indicated above.

By way of example, the support structure includes teeth and open-work cavities in alternation in at least one direction, this alternation comprising more than four or even more than five rows, and more than three or even more than four open-work cavities situated between the rows, for example.

In the embodiments shown in particular in FIGS. 19 to 41, the branch members that include the teeth and that cross over can be situated at different heights, as in FIG. 6 or in FIG. 22, for example, or they can be situated at the same height, as in FIG. 21.

In some embodiments, the support structure can include branch members that do not have any teeth, these branch members having a curve that can follow the curve defined by the ends of the teeth of a nearby row of teeth, for example. Such branch members can hide the bases of the teeth of at least one nearby row of teeth, to some extent.

In a variant not shown, the teeth can be made by cutting a metal sheet. The teeth can be cut then folded substantially at right angles to the plane of the sheet.

The term "comprising a" should be understood as being synonymous with "comprising at least one" unless specified to the contrary.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the present invention.

What is claimed is:

1. A packaging and applicator device for a composition comprising makeup or a care product for application to eyelashes or eyebrows, the device comprising:

an applicator comprising a support structure that is elongate along a longitudinal axis, the support structure comprising at least one branch member that is within the support structure at least in part, the support structure being an open-work structure; and/or at least one branch member having a free end;

the branch member extending, at least in part, obliquely relative to the longitudinal axis of the support structure and including teeth; and the composition for application to eyelashes or eyebrows.

2. A packaging and applicator device according to claim 1, including at least two rows of teeth, each of the rows of teeth having at least three teeth extending from a respective branch member of the support structure on one face thereof.

3. A packaging and applicator device according to claim 2, in which the rows of teeth extend obliquely relative to the longitudinal axis of the support structure.

4. A packaging and applicator device according to claim 1, in which at least one open-work cavity of the support structure extends, at least in part, between two rows of teeth.

5. A packaging and applicator device according to claim 1, comprising open-work cavities and teeth in alternation along a direction that is parallel to the longitudinal axis.

6. A packaging and applicator device according to claim 5, further comprising open-work cavities in the support structure and teeth alternating over more than half the length of the support structure.

7. A packaging and applicator device according to claim 1, comprising open-work cavities in the support structure and teeth in alternation along a direction that is perpendicular to the longitudinal axis.

8. A packaging and applicator device according to claim 7, further comprising open-work cavities in the support structure and teeth alternating over more than half the width of the support structure.

9. A packaging and applicator device according to claim 1, wherein the support structure defines at least two open-work cavities.

10. A packaging and applicator device according to claim 1, wherein the support structure defines at least three open-work cavities.

11. A packaging and applicator device according to claim 1, wherein the support structure comprises open-work cavities; and wherein the number of open-work cavities in one face of the support structure is in the range of 3 to 100.

12. A packaging and applicator device according to claim 1, wherein the support structure comprises at least one open-work cavity having a size that enables composition to be retained therein.

13. A packaging and applicator device according to claim 1, wherein the support structure comprises open-work cavities, at least a majority of the open-work cavities having a size that enables composition to be retained therein.

14. A packaging and applicator device according to claim 1, wherein the support structure comprises open-work cavities, at least one of the open-work cavities having a greatest dimension that is less than or equal to 3 mm.

15. A packaging and applicator device according to claim 1, wherein the support structure comprises open-work cavities, at least a majority of the open-work cavities having a greatest dimension that is less than or equal to 3 mm.

16. A packaging and applicator device according to claim 1, wherein the support structure comprises a closed frame that defines, at least in part, an open-work cavity.

17. A packaging and applicator device according to claim 16, wherein, in plan view, the frame has a shape selected from triangular, lenticular, kidney-shaped, rectangular, and peanut-shaped.

18. A packaging and applicator device according to claim 1, wherein the support structure comprises at least one branch member including two ends that are connected to the structure.

19. A packaging and applicator device according to claim 1, wherein at least one branch member is connected to the remainder of the support structure via a single junction zone.

20. A packaging and applicator device according to claim 19, wherein the junction zone is situated between two ends of the at least one branch member.

21. A packaging and applicator device according to claim 19, wherein the junction zone is situated at an end of the branch member.

22. A packaging and applicator device according to claim 1, wherein the support structure comprises a central core.

23. A packaging and applicator device according to claim 1, wherein the total number of teeth comprised in the applicator is in the range of 40 to 800.

24. A packaging and applicator device according to claim 1, wherein the support structure comprises two diametrically opposed faces; and wherein the number of teeth per $cm^2$ on one face of the support structure is in the range of 10 to 100.

25. A packaging and applicator device according to claim 1, wherein the number of branch members comprised in the applicator is in the range of about 5 to about 50.

26. A packaging and applicator device according to claim 1, wherein at least one branch member is rectilinear.

27. A packaging and applicator device according to claim 1, wherein at least one branch member is non-rectilinear.

28. A packaging and applicator device according to claim 27, wherein at least one non-rectilinear branch member is curved in a plane containing the longitudinal axis of the support structure.

29. A packaging and applicator device according to claim 27, wherein at least one non-rectilinear branch member is curved in a plane that does not contain the longitudinal axis of the support structure.

30. A packaging and applicator device according to claim 1, wherein at least one branch member is convex when observed along the longitudinal axis of the support structure.

31. A packaging and applicator device according to claim 1, wherein two adjacent branch members are spaced apart at most by a distance in the range of 0.01 mm to 2 mm.

32. A packaging and applicator device according to claim 1, wherein at least one branch member extends on either side of the longitudinal axis of the support structure when the applicator is observed from above.

33. A packaging and applicator device according to claim 1, wherein the support structure has a substantially flat shape.

34. A packaging and applicator device according to claim 1, wherein the support structure includes two opposite main faces, with teeth extending outwards from a single main face.

35. A packaging and applicator device according to claim 1, wherein the support structure includes two opposite main faces, with teeth extending outwards from each of the two main faces.

36. A packaging and applicator device according to claim 35, wherein the teeth comprise first teeth extending outwards from a first face of the support structure and from a first set of branch members, and second teeth extending outwards from a second face of the support structure and from a second set of branch members, the first face of the support structure being opposite from the second face.

37. A packaging and applicator device according to claim 36, wherein at least some of the branch members of the first set and at least some of the branch members of the second set form a non-zero angle between them.

38. A packaging and applicator device according to claim 37, wherein the non-zero angle is in the range of 10° to 170°.

39. A packaging and applicator device according to claim 36, wherein the branch members of the first set and the branch members of the second set are disposed at different heights relative to the support structure.

40. A packaging and applicator device according to claim 36, wherein at least some of the branch members of the first set and at least some of the branch members of the second set extend parallel to one another.

41. A packaging and applicator device according to claim 1, wherein the teeth comprise free ends defining an envelope surface;

wherein a cross-section of the envelope surface taken in a plane substantially orthogonal to the longitudinal axis, at at least one point along the longitudinal axis, is convex at least in part.

42. A packaging and applicator device according to claim 1, wherein free ends of the teeth of two different branch members define respective curved lines for each of the two different branch members, the two curved lines each having a high point that is furthest away from a geometrical mid-surface of the support structure, the two high points being situated differently from each other relative to the longitudinal axis of the support structure.

43. A packaging and applicator device according to claim 1, wherein the at least one branch member includes at least three different branch members, and wherein free ends of the teeth of the at least three different branch members define respective curved lines for each of the branch members, the three curved lines each having a high point that is furthest away from a geometrical mid-surface of the support structure, the three high points not being in alignment.

44. A packaging and applicator device according to claim 1, wherein the teeth are arranged in rows; and wherein at least one row comprises at least four teeth.

45. A packaging and applicator device according to claim 1, wherein the teeth are arranged in rows; and wherein the height of the teeth decreases at the ends of at least one of the rows.

46. A packaging and applicator device according to claim 1, wherein the support structure includes proximal and distal ends, and wherein the teeth each have a height that decreases at the proximal and distal ends of the support structure when the applicator is observed from its side.

47. A packaging and applicator device according to claim 1, wherein free ends of the teeth define an envelope surface of the applicator, the envelope surface having a convex longitudinal cross-section when the applicator is observed from its side.

48. A packaging and applicator device according to claim 1, further including at least one open-work cavity without teeth extending over the open-work cavity.

49. A packaging and applicator device according to claim 1, wherein the teeth are disposed in parallel rows.

50. A packaging and applicator device according to claim 1, wherein the teeth are arranged in rows; and wherein at least one row of teeth extends along an axis that is rectilinear.

51. A packaging and applicator device according to claim 1, wherein the teeth are arranged in rows; and wherein at least one row of teeth extends along an axis that is curvilinear.

52. A packaging and applicator device according to claim 1, wherein the teeth are made of the same material as the support structure.

53. A packaging and applicator device according to claim 1, wherein the teeth are made by injection molding onto a portion of the support structure a material that is different from material of another portion of the support structure.

54. A packaging and applicator device according to claim 1, comprising a stem fastened to the support structure.

55. A packaging and applicator device according to claim 54, wherein a thickness of the support structure, measured in its side view, is less than or equal to a greatest transverse dimension of the stem.

56. A method of applying a composition to eyelashes or eyebrows, the method comprising:

loading the applicator of the packaging and applicator device as defined in claim 1 with composition; and applying the composition to eyelashes or eyebrows.

57. A method according to claim 56, wherein the support structure includes open-work cavities; and wherein the applicator is loaded with composition in such a manner that the open-work cavities are filled with composition.

58. A method according to claim 57, wherein the support structure includes open-work cavities; and wherein, while loading the applicator with composition, the composition is forced to flow through the open-work cavities.

59. An applicator for applying a composition to eyelashes or eyebrows, the applicator comprising:

a support structure that is elongate along a longitudinal axis, the support structure comprising at least one branch member that is within the support structure at least in part, the support structure being an open-work structure; and/or at least one branch member having a free end;

the branch member extending, at least in part, obliquely relative to the longitudinal axis of the support structure and including teeth, the teeth having a height in the range of 1 mm to 12 mm.

60. An applicator for applying a composition to eyelashes or eyebrows, the applicator comprising:

a support structure that is elongate along a longitudinal axis, the support structure comprising at least one branch member that is within the support structure at least in part, the support structure being an open-work structure; and/or at least one branch member having a free end;

the branch member extending, at least in part, obliquely relative to the longitudinal axis of the support structure and including teeth; and a stem fastened to the support structure;

wherein an end of the stem remote from the support structure is connected to a closure cap for closing, in a leak-tight manner, a receptacle containing the composition for application.

* * * * *